US007000877B2

(12) United States Patent
Wang

(10) Patent No.: US 7,000,877 B2
(45) Date of Patent: Feb. 21, 2006

(54) BRACKET FOR CLOTHESHORSE

(75) Inventor: Chi-Chung Wang, Taolio (TW)

(73) Assignee: Chi Yu Steel Co., Ltd., Kaohsiung Hsien (TW)

( * ) Notice: Subject to any disclaimer, the term of this patent is extended or adjusted under 35 U.S.C. 154(b) by 92 days.

(21) Appl. No.: 10/726,133

(22) Filed: Dec. 1, 2003

(65) Prior Publication Data

US 2005/0116128 A1 Jun. 2, 2005

(51) Int. Cl.
*A47B 96/06* (2006.01)

(52) U.S. Cl. ..... 248/219.3; 248/235; 248/250; 248/340; 211/206; 211/85.3; 108/181

(58) Field of Classification Search ..... 248/219.3, 248/235, 250, 251, 146, 150, 340, 215, 239; 211/206, 189, 119.01, 85.3, 119.03, 204; 108/181, 153.1, 156
See application file for complete search history.

(56) References Cited

U.S. PATENT DOCUMENTS 414,181 A * 11/1889 Bardsley ..... 211/189
763,061 A * 6/1904 Keil ..... 248/242
913,228 A * 2/1909 McCarthy ..... 224/29.5
1,176,588 A * 3/1916 Miller et al. ..... 248/250
D164,503 S * 9/1951 Kerr ..... D3/259
3,079,003 A * 2/1963 Hilsinger, Jr. ..... 211/71.01
3,503,525 A * 3/1970 Loebner ..... 211/206
3,791,070 A * 2/1974 Roberts ..... 47/46
D261,571 S * 11/1981 Hanson ..... D3/259
4,854,456 A * 8/1989 Lee ..... 211/14
5,253,837 A * 10/1993 Loux ..... 248/250
5,351,842 A * 10/1994 Remmers ..... 211/90.03
5,570,792 A * 11/1996 Huang ..... 211/46
5,706,737 A * 1/1998 Whitehead et al. ..... 108/42
5,871,105 A * 2/1999 Whitehead et al. ..... 211/14
6,024,333 A * 2/2000 Raasch et al. ..... 248/247
6,443,410 B1 * 9/2002 Lee ..... 248/235

* cited by examiner

*Primary Examiner*—Kimberly Wood
(74) *Attorney, Agent, or Firm*—Dellett & Walters

(57) ABSTRACT

Brackets for a clotheshorse are used in pairs. Each bracket has multiple collars that align respectively with multiple collars defined in the other opposite bracket. A vertical socket is formed at a bottom of the bracket in which a telescoping rod of the clotheshorse is mounted. Multiple slots are vertically defined in the bracket and extend inward to respectively communicate with the multiple collars to hold longitudinal members of a rack inside the multiple collars through the slots. Thereby, a bracket assembly mounted on the clotheshorse enables versatile accessories to be mounted on the clotheshorse.

4 Claims, 8 Drawing Sheets

BRACKET FOR CLOTHESHORSE

BACKGROUND OF THE INVENTION

1. Field of the Invention

The invention relates to a bracket for a clotheshorse, and particularly to a bracket for a clotheshorse that is placed on a base of the clotheshorse to arrange versatile accessories on the clotheshorse.

2. Description of Related Art

With reference to FIG. 8, a conventional clotheshorse (30) is composed of a base (31), two telescoping rods (32), two Y-shaped connectors (33), a rack (35) and an optional hanging rod (34). The base (31) is rectangular and has two ends. The two telescoping rods (32) are respectively mounted on the two ends of the base (31). The Y-shaped connectors (33) are mounted respectively on the telescoping rods (32). Each Y-shaped connector (33) has a vertical socket (331), two arms (333) and a transverse recess (332). The vertical socket (331) has a top (not numbered) and an open bottom (not numbered). The arms (333) join the top of the vertical socket (331) to form a joint and extend out from the top of the vertical socket (331) in opposite directions to form a Y-shape. The transverse recess (332) is defined at the joint of the arms (333) and the vertical socket (331) through the connector (33). Each arm (333) of the connector (33) has a distal end and a lip (334) formed at the distal end.

The telescoping rods (32) are mounted on the base (31), and the top ends of the telescoping rods (32) are mounted respectively in the vertical sockets (331) in the Y-shaped connectors (33). The rack (35) composed of multiple rigid crossed members is mounted on the arms (333) and is held in place by the lips (334). The hanging rod (34) has two ends inserted respectively into the transverse recesses (332) in the paired Y-shaped connectors (33).

However, the conventional clotheshorse (30) has the following drawbacks:

1. Other accessories such as panels cannot attach to the clotheshorse (30) because the lip (334) is only suitable for supporting the rack (35). Additionally, small-sized objects cannot be placed on the rack (35) because the objects will fall through holes on the rack (35). Therefore, usage of the clotheshorse (30) is limited.

2. The clotheshorse (30) only has one hanging rod (34) so that a person cannot hang more clothes on the clotheshorse (30). The quantity of clothes the clotheshorse (30) will accommodate is limited.

3. The rack (35) is easily detached from the two connectors (33) because the cross members of the rack (35) only rest on the arms (333) and are only held in place by the lips (344) at corners. Therefore, the rack (35) is easily deformed when too much weight is loaded on the rack (35) because the four arms (333) of the Y-shaped connectors (33) cannot provide distributed support of the rack (35). Moreover, the cross members on the rack (35) easily slide on the arms (333) when the clotheshorse (30) vibrates.

The present invention has arisen to provide a bracket for a clotheshorse to eliminate or obviate the drawbacks of the conventional clotheshorse.

SUMMARY OF THE INVENTION

A first objective of the present invention is to provide a bracket for a clotheshorse, which increases versatility of the clotheshorse.

A second objective of the present invention is to provide a bracket for a clotheshorse, which stably supports versatile detachable accessories.

Further benefits and advantages of the present invention will become apparent after a careful reading of the detailed description when taken in conjunction with the drawings.

DETAILED DESCRIPTION OF THE PREFERRED EMBODIMENT

A bracket for a clotheshorse in accordance with the present invention is used on a clotheshorse in pairs to hold multiple rods, racks, shelves or other accessories between two brackets. The two brackets with the versatile and detachable accessories are called a "bracket assembly" in the following description.

Figure 1:
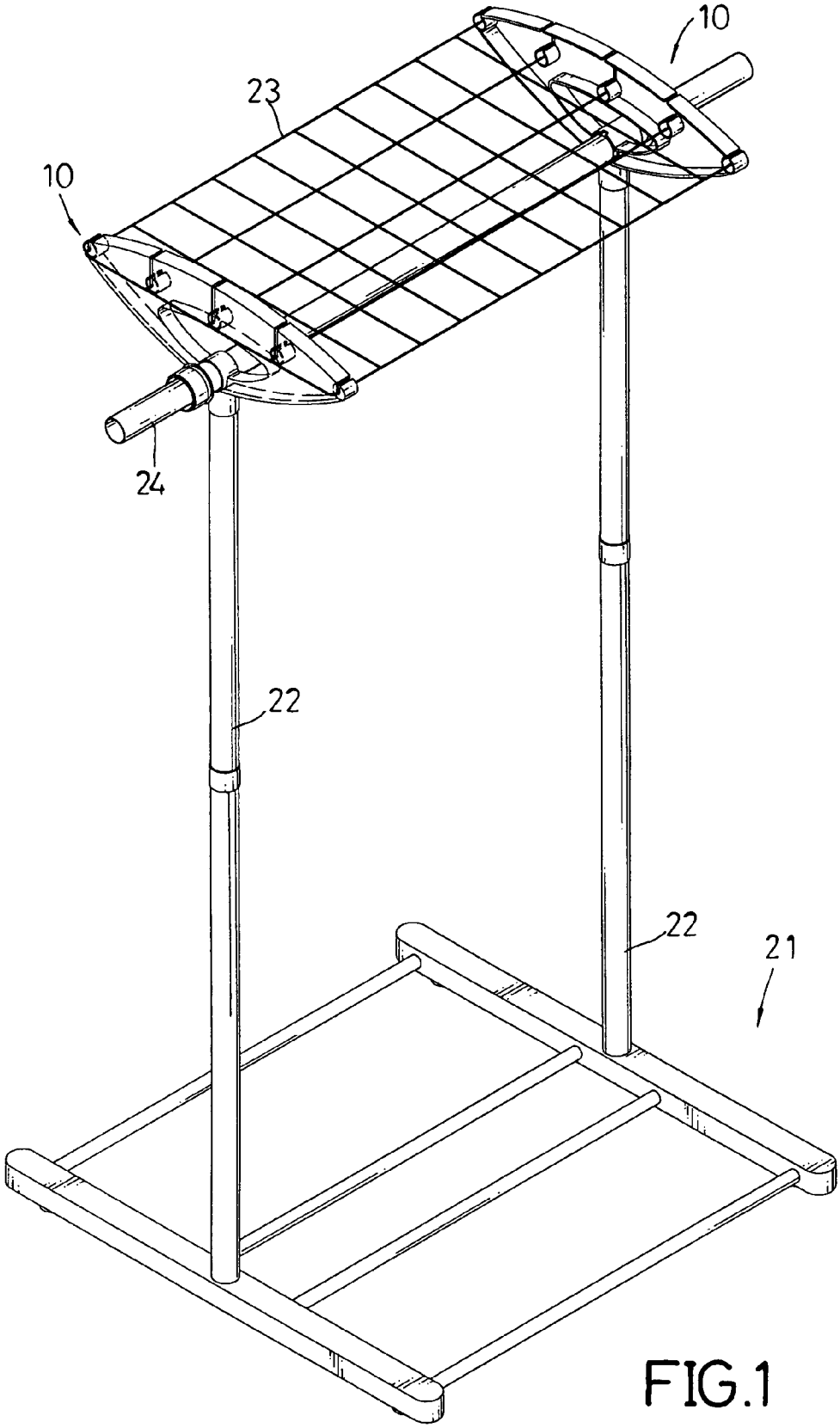
FIG. 1 is a perspective view of a clotheshorse having a bracket assembly in accordance with the present invention.

With reference to FIG. 1, a clotheshorse comprises a base (21), two telescoping rods (22) and a bracket assembly (not numbered). The base (21) is a rectangular frame having two ends (not numbered). The two telescoping rods (22) are mounted respectively on the two ends of the base (21). Each telescoping rod (22) has a distal end (not numbered). The bracket assembly is detachably mounted on the distal ends of the two telescoping rods (22).

Figure 2:
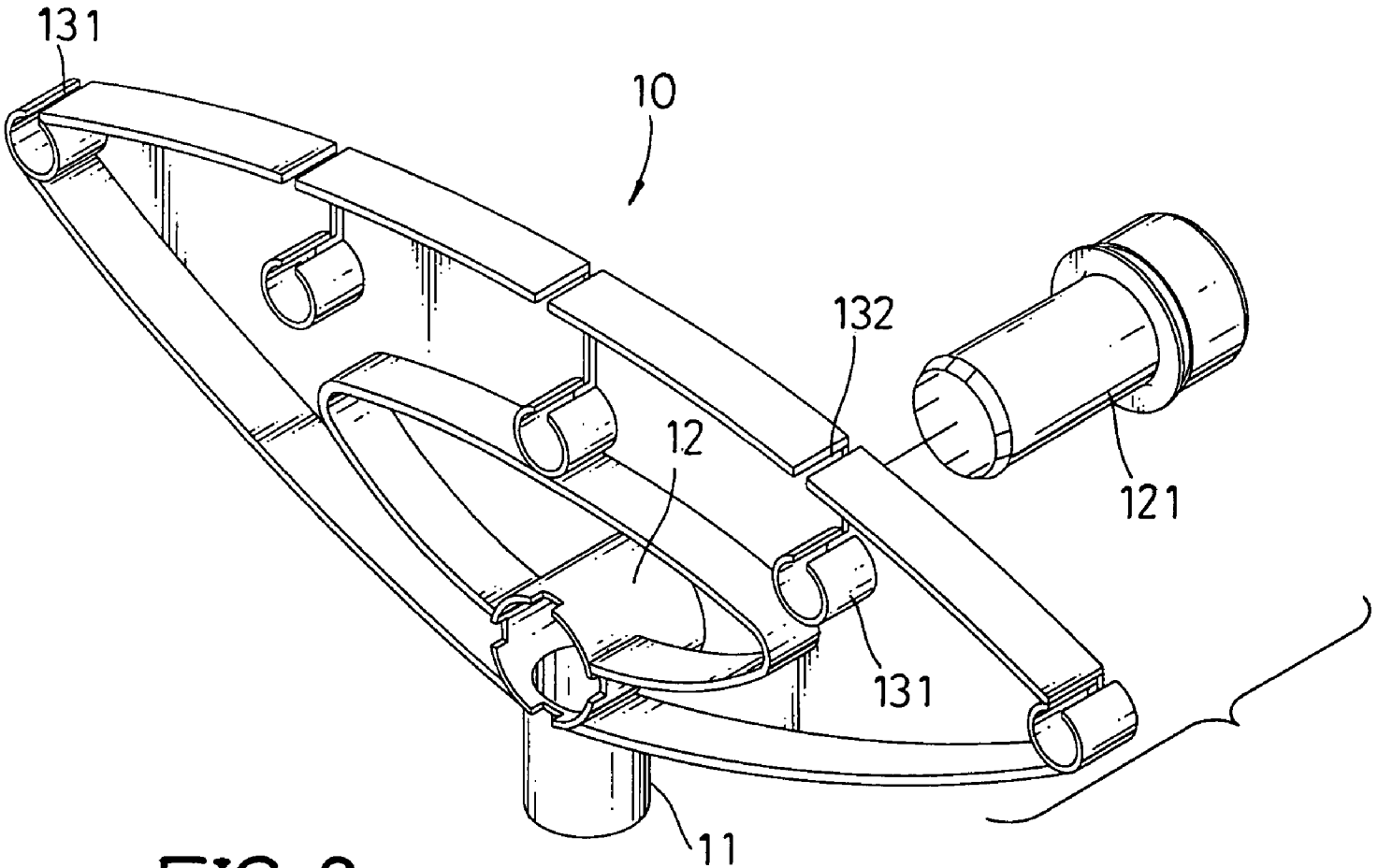
FIG. 2 is an enlarged exploded perspective view of a bracket in FIG. 1.
Figure 3:
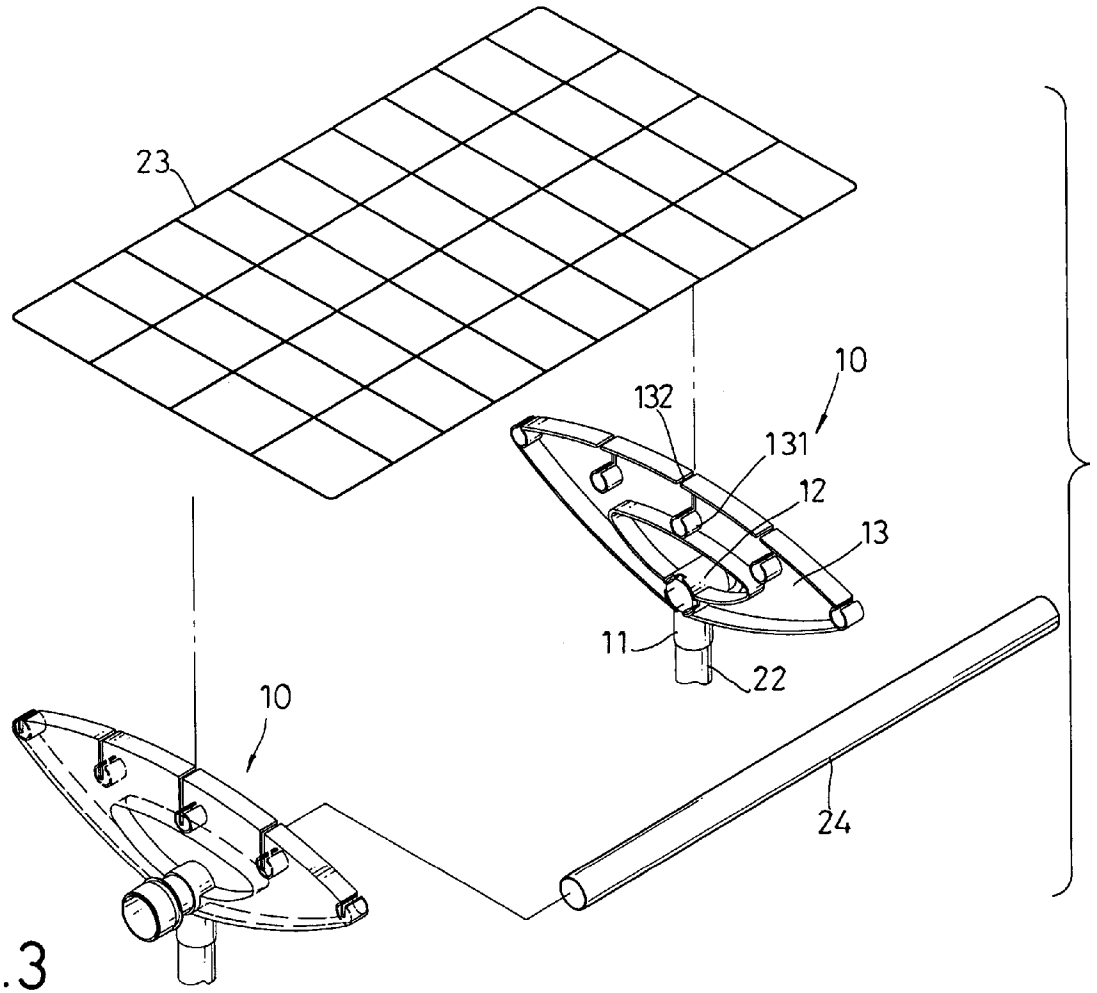
FIG. 3 is an enlarged exploded perspective view of the bracket assembly as in FIG. 1 with a rack and a hanging rod.

With further reference to FIGS. 2 and 3, the bracket assembly comprises two brackets (10) in accordance with the present invention, an optional hanging rod (24) and an optional rack (23) composed of multiple transverse and longitudinal members.

Each bracket (10) is composed of a fan-shaped plate (13) with an inner tan-shaped opening (not numbered), multiple optional flanges (not numbered), multiple collars (12, 131), multiple slots (132), a vertical socket (11) and two ends (not numbered). The fan-shaped plate (13) has an arced upper edge and two side edges. Multiple flanges are extendedly formed on the arced upper edge, the two side edges and around the inner fan-shaped opening. The multiple collars on one bracket (10) comprise multiple first collars (131) and a second collar (12) that align respectively with the collars (12, 131) on the other bracket (10). The first collars (131) are in a line, are evenly spaced above the inner fan-shaped opening near the arced upper edge, protrude from one side of the plate (13) and correspond to the longitudinal members of the rack (23) and each has a free end. One first collar (131)

is defined at each end of the bracket (10). The second collar (12) is defined in the fan-shaped plate (13) below the inner fan-shaped opening near a joint of the two side edges on the fan-shaped plate (13). The multiple slots (132) are defined in the flange on the arced upper edge, extend respectively to the free ends of the first collars (131) and extend inward to communicate respectively with the first collars (131). The vertical socket (11) is formed at the joint of the side edges of the fan-shaped plate (13).

Figure 4:
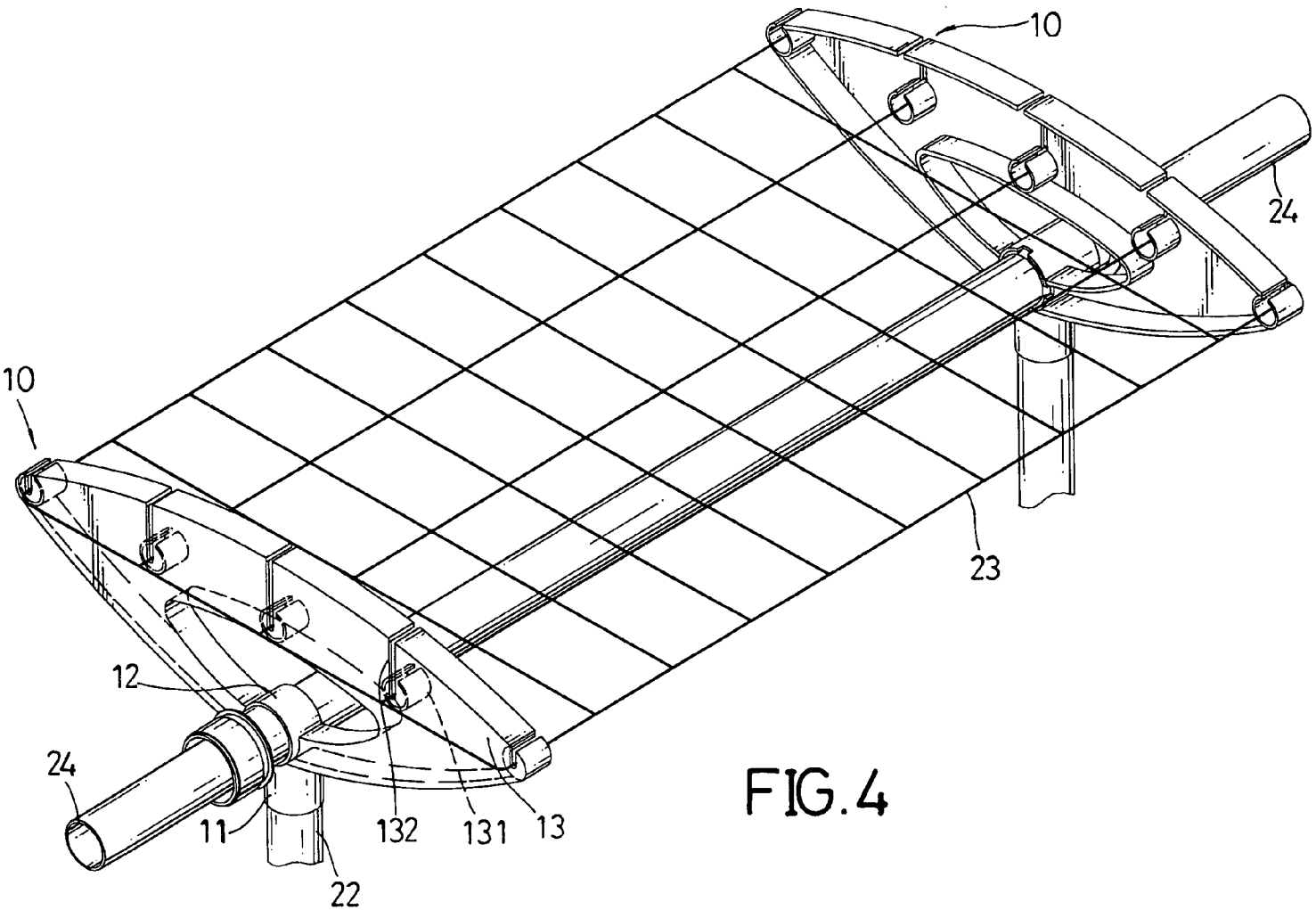
FIG. 4 is an enlarged perspective view of the bracket assembly in FIG. 3.

With further reference to FIG. 4, the bracket assembly is attached to the base (21) by inserting the distal ends of the telescoping rods (22) respectively into the vertical sockets (11) on the two brackets (10).

The hanging rod (24) has two end caps (121) and is mounted detachably between the two brackets (10) by inserting the two end caps (121) respectively into the second collars (12) on the two brackets (10). When the rack (23) is mounted on the two brackets (10), the longitudinal members of the rack (23) near the ends of the rack (23) are mounted respectively inside first collars (131) through the slots (132). Therefore, the rack (23) cannot slide on the two brackets (10) so displacement of the rack (23) is prevented.

Figure 5:
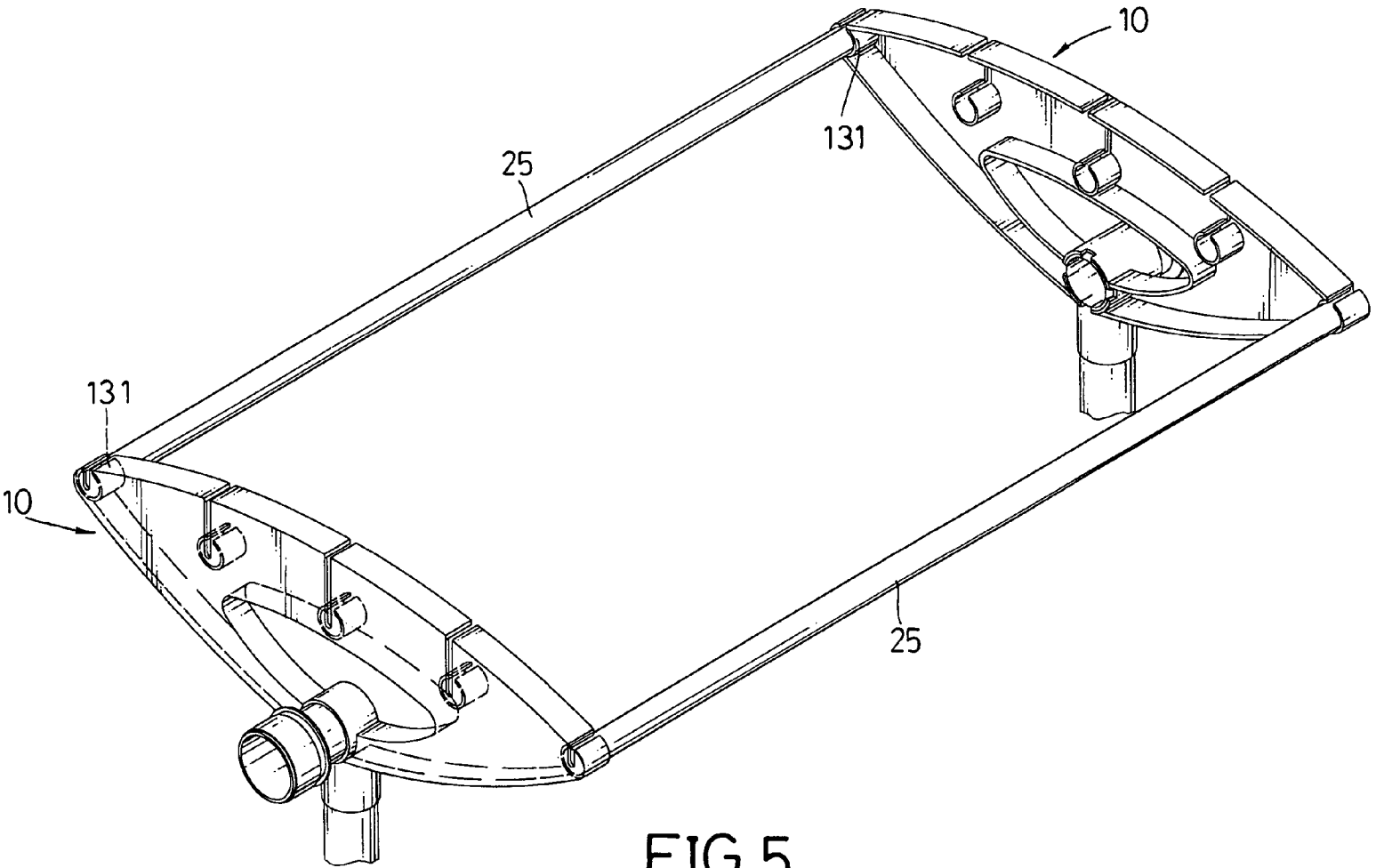
FIG. 5 is an enlarged perspective view of another operational embodiment of the bracket assembly in accordance with the present invention with two supplementary hanging rods.

With reference to FIG. 5, another operational embodiment of the bracket assembly has two supplementary hanging rods (25). The supplementary hanging rods (25) extend respectively between corresponding ends of the two brackets (10) to add two more rods from which clothes can be suspended. Furthermore, additional supplementary hanging rods (not shown) can be mounted between corresponding pairs of first collars (131) in the two brackets (10) to increase the capability to suspend clothes.

Figure 6:
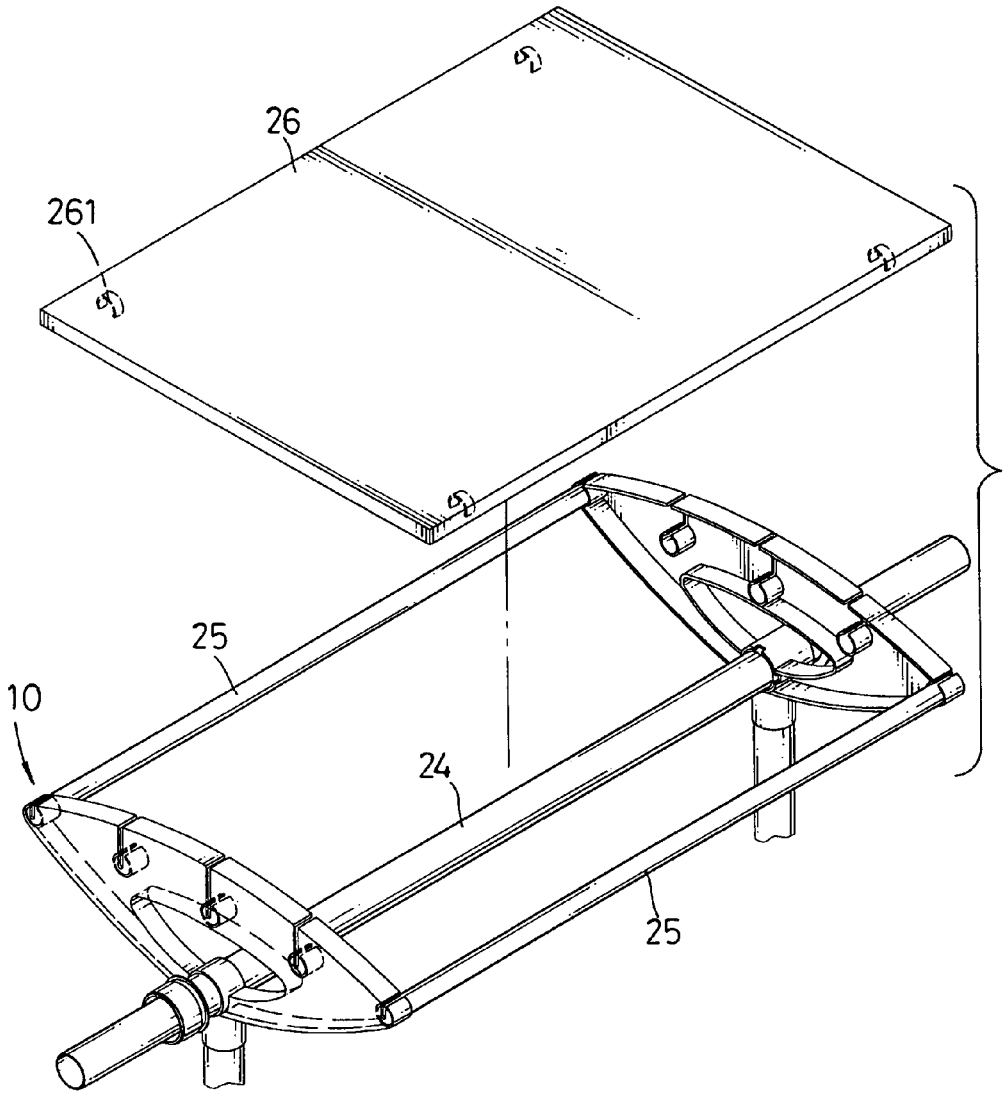
FIG. 6 is an enlarged exploded perspective view of still another operational embodiment of the bracket assembly in accordance with the present invention with a panel mounted on the two supplementary hanging rods in FIG. 5.
Figure 7:
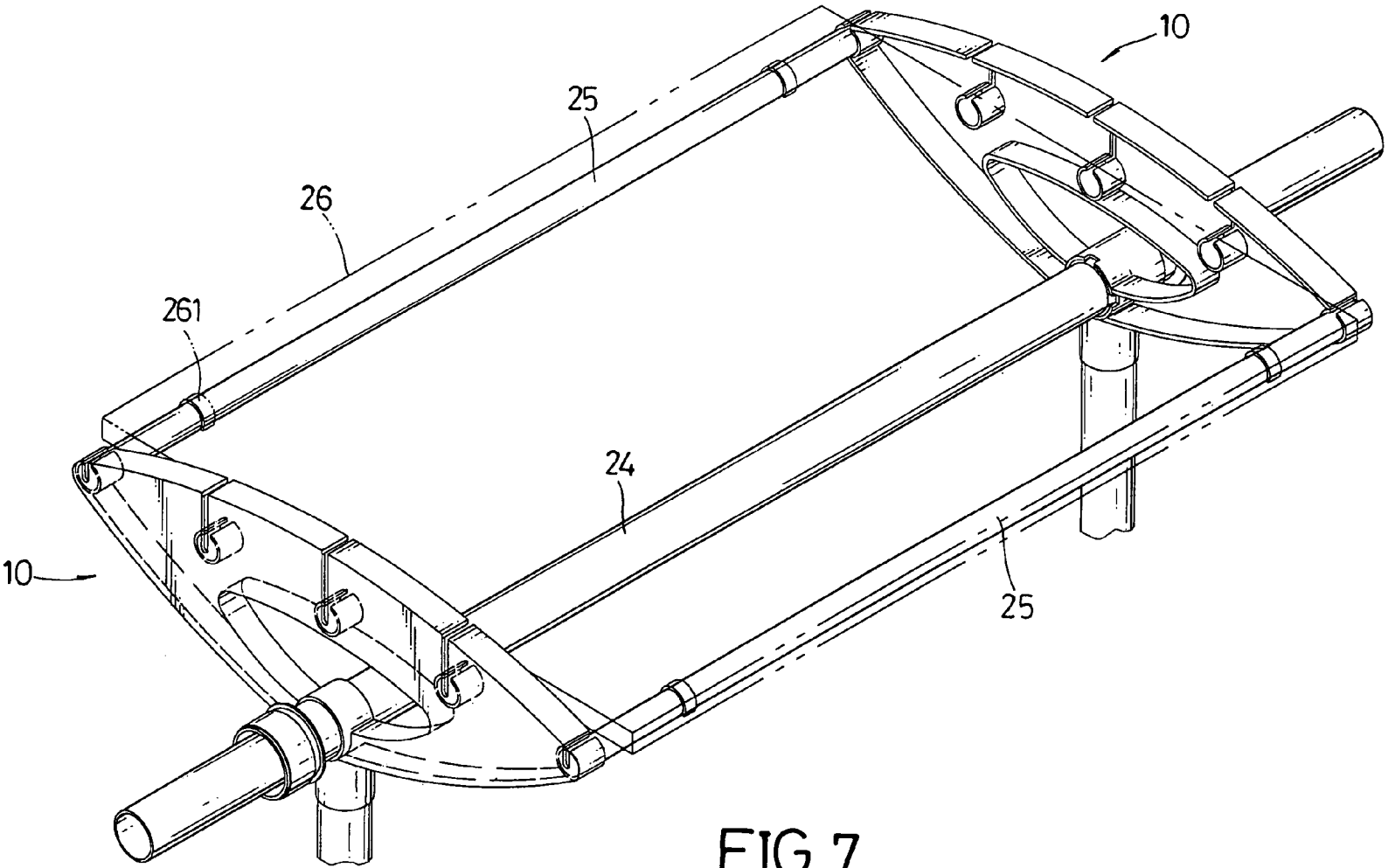
FIG. 7 is an enlarged perspective view of the operational embodiment of the bracket assembly in FIG. 6.
Figure 8:
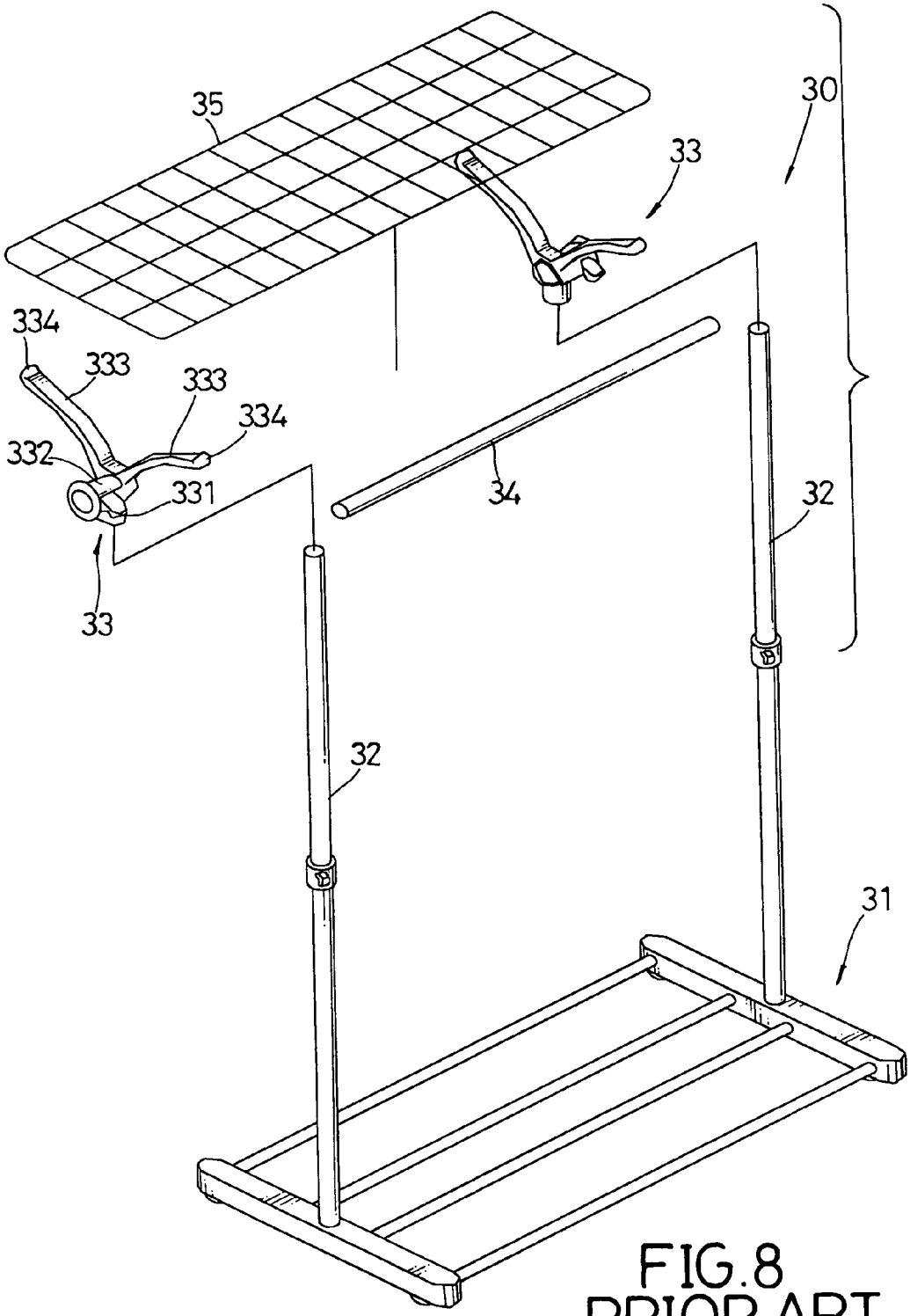
FIG.8 PRIOR ART
FIG. 8 is an exploded perspective view of a conventional clotheshorse in accordance with the prior art.

With reference to FIGS. 6 and 7, an optional panel (26) may be detachably mounted on the two supplementary hanging rods (25). The panel (26) has a bottom face and four C-shaped resilient clamps (261) attached to the bottom face with openings facing to the supplementary hanging rods (25). Thereby, the panel (26) is firmly attached on the supplementary hanging rods (25) by clamping the C-shaped resilient clamps (261) to the supplementary hanging rods (25).

The bracket assembly containing the brackets in accordance with the present invention has the following advantages:

1. The bracket assembly enables accessories to be selectively added to or remove from the clotheshorse to meet a person's various requirements. For example, multiple supplementary hanging rods (25) can be mounted between the two brackets (10) to increase the capacity to suspend clothes.

2. When the rack (23) is mounted on the two brackets (10), the longitudinal members are mounted inside the first collars (131) via the slots (132) to keep the rack (23) from sliding on the two brackets (10). Additionally, the rack (23) is supported on the two brackets (10) evenly at the ends instead of at four corners as with the conventional Y-shaped connectors. Therefore, the rack (23) is safe from sliding or deforming and is stable.

Although the invention has been explained in relation to its preferred embodiment, many other possible modifications and variations can be made without departing from the spirit and scope of the invention as hereinafter claimed.

What is claimed is:

1. A bracket for a clotheshorse, the bracket comprising:

a plate with a top edge and multiple side edges;

multiple first collars being in a line, protruding from the side of the plate near the top edge and having a free end;

multiple slots defined in the top edge of the plate and extending respectively to the free ends of the first collars to respectively communicate with the multiple first collars; and a vertical socket (11) attached to the plate under the first collars.

2. The bracket as claimed in claim 1, wherein the plate is fan shaped with an arced upper edge at the top edge, two side edges, and a joint of the two side edges;

wherein a second collar is defined in the plate near the joint.

3. The bracket as claimed in claim 1, wherein the plate has an inner opening with edges; and multiple flanges extendedly formed on the edges of the inner opening, top edge and the multiple side edges of the plate, wherein the multiple slots are defined through the flange at the top edge of the plate.

4. The bracket as claimed in claim 2, wherein the plate has an inner opening with edges; and multiple flanges extendedly formed on the edges of the inner opening, top edge and the two side edges of the plate, wherein the multiple slots are defined through the flange at the top edge of the plate.

* * * * *